US009173455B2

(12) United States Patent
Chapron

(10) Patent No.: US 9,173,455 B2
(45) Date of Patent: Nov. 3, 2015

(54) DEVICE FOR CLOSING AND FASTENING TWO LENGTHS OF FLEXIBLE STRAPPING

(76) Inventor: Denis Chapron, Saumur (FR)

( * ) Notice: Subject to any disclaimer, the term of this patent is extended or adjusted under 35 U.S.C. 154(b) by 85 days.

(21) Appl. No.: 13/634,554

(22) PCT Filed: Mar. 28, 2011

(86) PCT No.: PCT/FR2011/050666

§ 371 (c)(1),
(2), (4) Date: Nov. 20, 2012

(87) PCT Pub. No.: WO2011/124816

PCT Pub. Date: Oct. 13, 2011

(65) Prior Publication Data

US 2013/0055532 A1 Mar. 7, 2013

(30) Foreign Application Priority Data

Mar. 29, 2010 (FR) ..... 10 01253

(51) Int. Cl.
*A44B 11/04* (2006.01)
*A44B 11/18* (2006.01)
*A44B 11/25* (2006.01)

(52) U.S. Cl.
CPC ..... *A44B 11/18* (2013.01); *A44B 11/04* (2013.01); *A44B 11/25* (2013.01); *Y10T 24/2192* (2015.01); *Y10T 24/4086* (2015.01); *Y10T 24/4093* (2015.01); *Y10T 24/4736* (2015.01); *Y10T 24/4764* (2015.01)

(58) Field of Classification Search
CPC ..... A44B 11/04; A44B 11/18; A44B 11/25; Y10T 24/4086; Y10T 24/4736; Y10T 24/4093; Y10T 24/2192; Y10T 24/4764
USPC ..... 24/68 E, 197, 200, 265 BC, 265 AL
See application file for complete search history.

(56) References Cited

U.S. PATENT DOCUMENTS

| | | | | | |
|---|---|---|---|---|---|
| 369,237 | A | * | 8/1887 | Donahue | 24/198 |
| 434,926 | A | * | 8/1890 | Hall et al. | 24/200 |
| 745,884 | A | * | 12/1903 | Morton | 24/198 |
| 787,335 | A | * | 4/1905 | Lambert | 24/200 |
| 1,221,741 | A | * | 4/1917 | Johnson | 24/169 |

(Continued)

FOREIGN PATENT DOCUMENTS

FR 2 192 781 A1 2/1974

OTHER PUBLICATIONS

International Search Report, dated Sep. 6, 2011, from corresponding PCT application.

*Primary Examiner* — Robert J Sandy
*Assistant Examiner* — Louis Mercado
(74) *Attorney, Agent, or Firm* — Young & Thompson

(57) ABSTRACT

A device for closing and fastening two sections of flexible band, particularly two end sections (15*a*, 15*b*) of flexible belt band, is equipped with fastening elements (1), which include an end keeper (2), intend to be fixed to a first band section (15*a*), and a lateral keeper (3), intend to come at the second band section (15*b*) which the second band section intend to come at the two keepers (2, 3) during closing and fastening operations, by being successively introduced, starting from the lateral keeper (3), through the opening (5) of the end keeper (2), the rear opening (9) of the lateral keeper (3) and the front opening (8) of this same lateral keeper (3), so as to be folded into a generally S-shape, with three superimposed portions (15*b*1, 15*b*2, and 15*b*3).

7 Claims, 2 Drawing Sheets

(56) References Cited

U.S. PATENT DOCUMENTS

| | | | | | |
|---|---|---|---|---|---|
| 1,351,728 | A | * | 9/1920 | Auerbach | 24/712 |
| 1,814,978 | A | * | 7/1931 | Swanson | 24/19 |
| 2,058,931 | A | | 10/1936 | Williams | |
| 2,569,933 | A | | 10/1951 | Johnson | |
| 2,809,408 | A | * | 10/1957 | Goldstein | 24/312 |
| 3,192,587 | A | * | 7/1965 | White | 24/200 |
| 3,267,490 | A | * | 8/1966 | Wallace | 2/323 |
| 3,327,361 | A | * | 6/1967 | Mathison | 24/198 |
| 6,141,835 | A | * | 11/2000 | Wilson | 24/68 E |
| 2004/0226147 | A1 | | 11/2004 | Fildan et al. | |

* cited by examiner

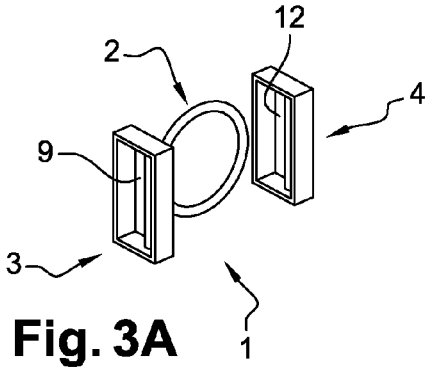
Fig. 3A
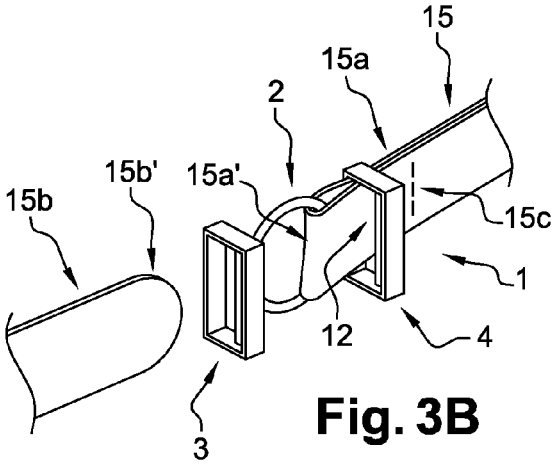
Fig. 3B
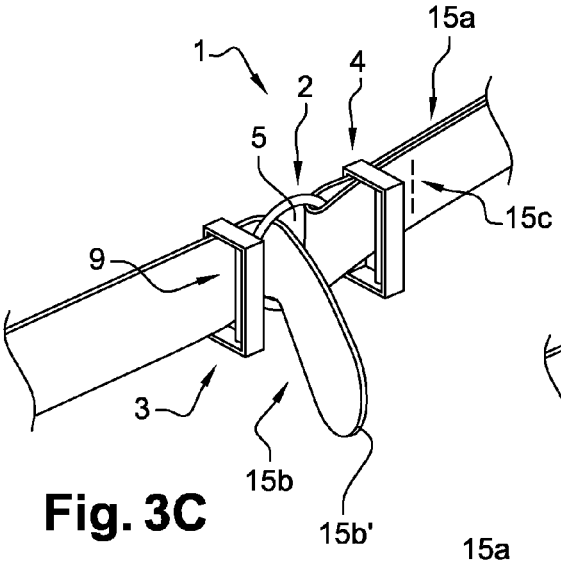
Fig. 3C
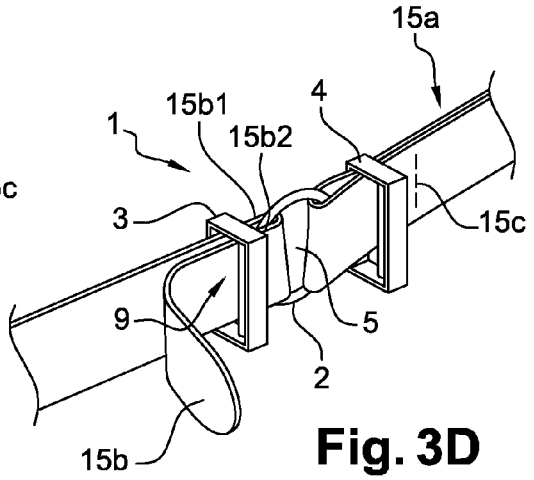
Fig. 3D
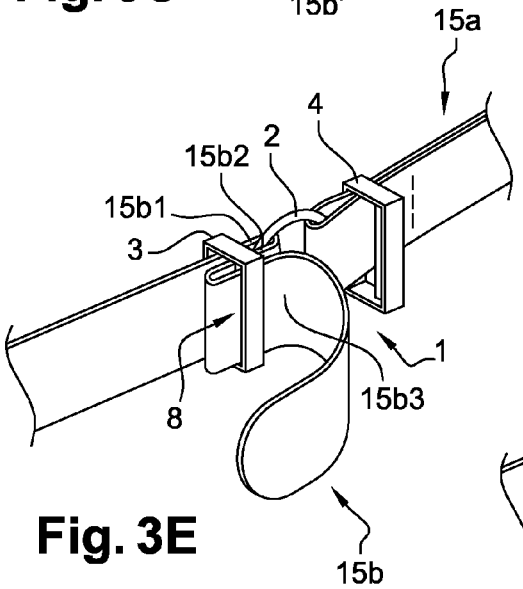
Fig. 3E
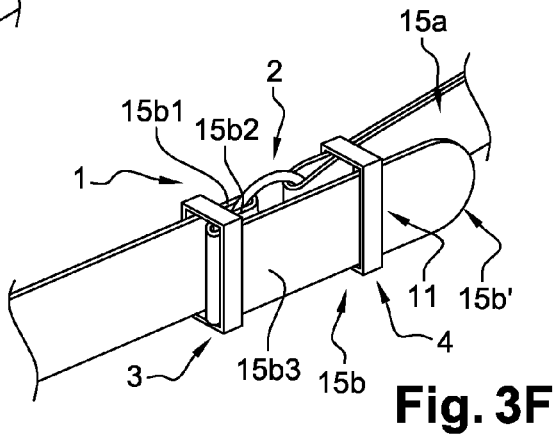
Fig. 3F
Fig. 3

DEVICE FOR CLOSING AND FASTENING TWO LENGTHS OF FLEXIBLE STRAPPING

The present invention relates to a device for closing and tightening two sections of a flexible band, in particular two sections of a flexible belt band, which are equipped with structural means for their fastening to each other.

The belts, in particular those used as clothing accessories, comprise a band, made of a flexible material, which is ended by two end sections equipped with structural means for their fastening to each other.

Such fastening means generally consist of structures such as tongues, prongs, rings or slider buckles.

The present invention provides an alternative closure solution, having a simple structure and offering an original aesthetic aspect.

The corresponding fastening means are characterized by comprising two keeper parts, i.e., on the one hand, an end keeper arranged at the free end of a first band section, comprising an opening provided for the crossing of the second band section, and on the other hand, a lateral keeper intended to come at said second band section, remote from the free end of the latter, said lateral keeper comprises two openings, a rear one and a front one, separated by a transverse structural element, for the crossing of said second band section during the closing and tightening operations.

Said second band section is intended to cooperate with both keepers during said closing and tightening operations, by being successively introduced, starting from said lateral keeper, through the opening of the end keeper, the rear opening of said lateral keeper and the front opening of this same lateral keeper, so as to be folded into a generally S-shape, with three superimposed portions, i.e., successively, (i) a rear portion extending from said lateral keeper to the opening of said end keeper, (ii) an intermediate portion extending from said opening of the end keeper to the rear opening of said lateral keeper, and (iii) a front portion comprising the free end of said band section, extending through the front opening of said lateral keeper toward said end keeper.

Other advantageous characteristics of the invention, which can be considered in combination or independently from each other, are presented hereinafter:

- the first band section is folded over itself and through the opening of the end keeper, to ensure the fixation of the latter; in this case, the end keeper is preferably generally ring-shaped or buckle-shaped;
- the height of the end keeper is higher than the height of the rear opening of the lateral keeper, to avoid the crossing thereof through said rear opening;
- the transverse element of the lateral keeper has a fixed position, and the rear opening of said lateral keeper has a width that it higher than that of the front opening thereof; in this case, the width of the rear opening of the lateral keeper corresponds to twice, or approximately twice, the width of the front opening, said rear opening being intended to be passed through by the rear portion and the intermediate portion of the second band section;
- the lateral keeper has advantageously a generally rectangular shape and is consisted of two lateral rods associated with two junction rods; moreover, the transverse element consists of a rod located between said lateral rods, parallel to the latter and linking said junction rods;
- the fastening means further comprise a holding keeper that is located at the first band section, remote from the free end thereof, said holding keeper comprises two openings separated by a transverse element, i.e. a rear opening and a front opening, intended to be passed through by the first band section and by the front portion of the second band section, respectively; preferably, this holding keeper has a structure identical to that of the above-mentioned lateral keeper;
- the lateral keeper, and possibly the holding keeper, are mounted to slide freely on the flexible band sections.

The invention will be further illustrated, without being in any way limited, by the following description of a particular embodiment, given only by way of example, in relation with the appended drawings in which:

FIG. 3 shows the main steps of manoeuvring the flexible band through the keepers constitutive of the fastening means of FIG. 1.

Figure 1:
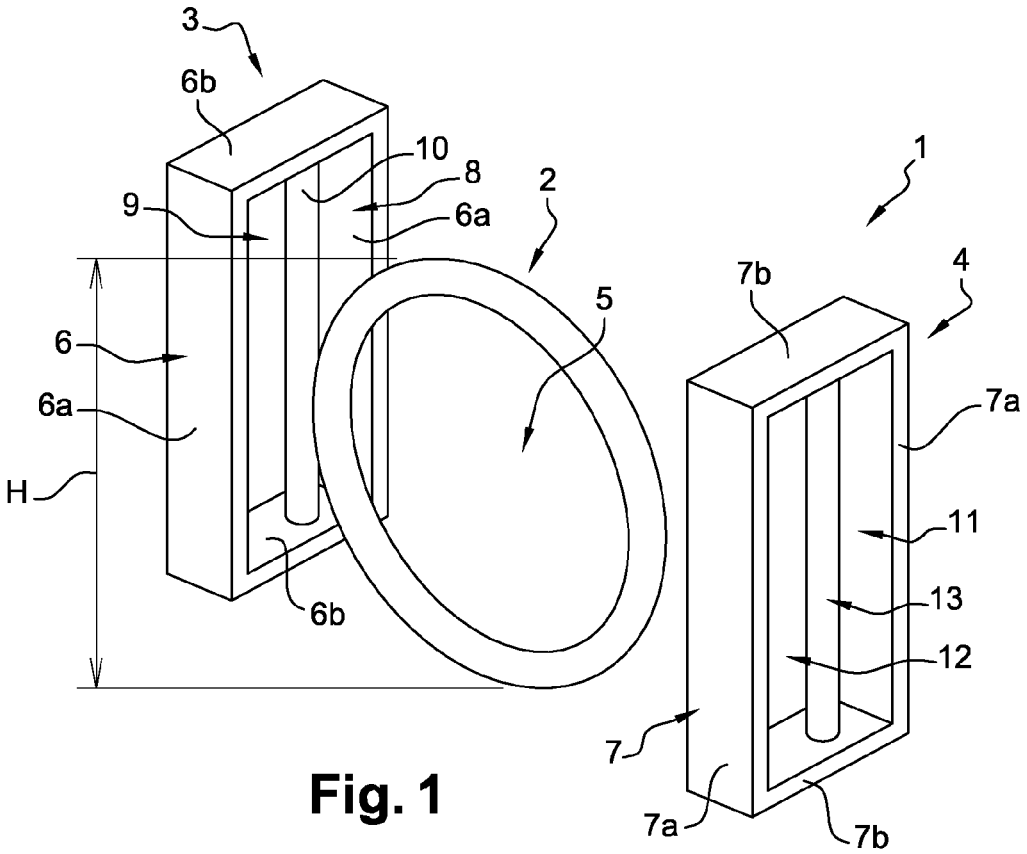
FIG. 1 is a general view, in perspective from the rear side, of the fastening means according to the invention, intended to equip the band of a clothing belt.
Figure 2:
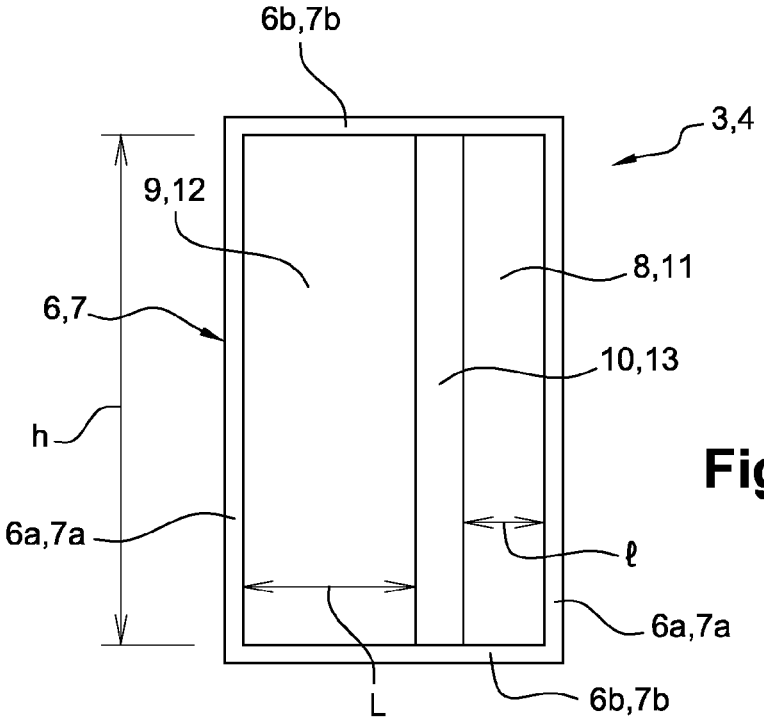
FIG. 2 is a side view of the lateral keeper or of the holding keeper, constitutive of the fastening means of FIG. 1.

The fastening means 1, shown in FIGS. 1 and 2, are intended to equip the end sections of a band or strap, made of a flexible material. Those assembled elements form together a belt, in particular for a clothing accessory purpose.

The corresponding fastening means 1 herein comprise three parts, each of which constitutes a keeper for the belt band, as described hereinafter with reference to FIG. 3, i.e.:

(i) an end keeper 2, intended to be arranged at a first end section of the band, (ii) a lateral keeper 3, intended to come at a second end section of the band, and (iii) a holding keeper 4, intended to be located at said first end section of the band and near the end keeper 2.

The end keeper 2 herein consists of a ring-shaped or buckle-shaped part, which is generally circular in shape.

As an alternative, this part 2 may also be generally oval, rectangular, square, or of another shape.

This end keeper 2 defines a central opening 5, also generally circular in shape, provided for the crossing of the second end section of the band, during the closing and tightening operations.

The lateral keeper 3 and the holding keeper 4 have structures that are herein identical, or at least similar, to each other.

This lateral keeper 3 and this holding keeper 4 each consist of a unitary part, made of a metal material.

As shown in FIGS. 1 and 2, these two keepers 3 and 4 each comprise a body, denoted by the references 6 and 7, respectively, which has herein a generally rectangular shape, consisted of two lateral rods and two junction rods, denoted by the references 6*a*, 6*b* and 7*a*, 7*b*, respectively.

The body 6, 7 of each of these two keepers 3, 4 delimits two openings separated by a transverse structural element, i.e.:

- the lateral keeper 3 comprises a front opening 8 and a rear opening 9, separated by the transverse structural element 10, and
- the holding keeper 4 comprises a front opening 11 and a rear opening 12, separated by a transverse structural element 13.

The transverse structural element 10, 13 in question has a fixed position. It consists of a cylindrical rod located between said lateral rods 6*a*, 7*a*, parallel to these latter, and the ends of which are linked to each of the junction rods 6*b*, 7*b*.

Moreover, this transverse element 10, 13 is arranged within each of the two keepers 3, 4, in such a manner that the width L of the rear opening 9, 12 corresponds to twice, or approximately twice, the width l of the front opening 8, 11 (FIG. 2).

The height h of the openings 8, 9 and 11, 12 of the lateral keeper 3 and the holding keeper 4, respectively, is defined by the connection rods 6*b* and 7*b*.

This height h is lower than the height H of the end keeper 2, around a portion of this end keeper 2 (or, in this case, of the diameter thereof), to avoid any possibility of crossing of the latter through the lateral keeper 3 or the holding keeper 4, during closing and tightening operations.

The assembling of the parts 2, 3 and 4, constitutive of the fastening means 1, with the band or strap 15 of a belt is described in detail hereinafter with reference to FIG. 3.

The three parts constitutive of the assembling means 1, i.e. the end keeper 2, the lateral keeper 3 and the holding keeper 4, are also shown in FIG. 3A.

A band 15 (partially shown) is firstly suitably linked to the end keeper 2 and the holding keeper 4, as illustrated in FIG. 3B.

This band 15, made of a flexible material, consists for example of a band of leather or a band of textile material. It is ended by two end sections 15*a* and 15*b*, each having a free end 15*a*' and 15*b*' (on the right and the left of FIG. 3, respectively).

As illustrated in FIG. 3B, a first end section 15*a* of the flexible band 15 is folded over itself and through the opening 5 of the end keeper 2, to form an assembling hem closed for example by means of a seam or rivets 15*c*, so as to ensure the fixation of said end keeper 2.

This portion folded over through the end keeper 2, around a segment of length of this end keeper 2, constitutes the free end 15*a*' of this first flexible band section 15*a*. It is to be noted that this first section 15*a* is further introduced in the rear opening 12 of the holding keeper 4.

The holding keeper 4 is then located at the first end section 15*a*, remote from the free end 15*a*' of the latter. This holding keeper 4 is herein mounted to slide freely on the flexible band 15.

To close, tighten and adjust the flexible band 15 by means of the three keepers 2, 3 and 4, the user handles the second end section 15*b* of the flexible band 15, by successively introducing it through:

(i) the rear opening 9 of the lateral keeper 3, toward the end keeper 2 (FIG. 3C), (ii) the opening 5 of the end keeper 2, from the rear to the front (FIG. 3C), (iii) the rear opening 9 of the lateral keeper 3, by moving the free end 15*b*' away from the end keeper 2, so as to adjust the length and the tightening of the band 15 (FIG. 3D), (iv) the front opening 8 of this same lateral keeper 3, again toward the end keeper 2, to lock the tightening applied (FIG. 3E), and (v) the front opening 11 of the holding keeper 4, to terminate the assembling (FIG. 3F).

As can be seen in FIG. 3F, the second end section 15*b* of the strap 15 is then folded into a generally S-shape, with three superimposed portions, i.e., successively:

(i) a rear portion 15*b*1 extending from the rear opening 9 of the lateral keeper 3 to the opening 5 of the end keeper 2, (ii) an intermediate portion 15*b*2 extending from the opening 5 of the end keeper 2 to the rear opening 9 of the lateral keeper 3, and (iii) a front portion 15*b*3 comprising the free end 15*b*' of the second section 15*b*, extending through the front opening 8 of the lateral keeper 3, in front of the end keeper 2 and through the front opening 11 of the holding keeper 4.

It can also be observed in FIG. 3F that:

the rear 15*b*1 and intermediate 15*b*2 portions of the second end section 15*b* are folded over each other, and wound around the end keeper 2, the intermediate 15*b*2 and front 15*b*3 portions of this second end section 15*b* are folded over each other, and wound around the transverse element 10 of the lateral keeper 3.

In this configuration, it can be seen that the two lateral rods 6*a*, 7*a* and the two junction rods 6*b*, 7*b* extend along the height and the thickness, respectively, of the so-folded flexible band 15.

The fastening means according to the invention serve to maintain the tightening of the belt, by a simple and efficient sliding/locking phenomenon, adapted to perfectly fit the morphology of the individual user.

It will be noted that the holding keeper 4 is not indispensable and can possibly not be present. Nevertheless, it permits to strengthen the tightening of the closure and to ensure a good holding of the free end of the belt. The presence thereof further provides a certain visual symmetry on either side of the central buckle, which is a plus in terms of aesthetical aspect.

Regarding the manufacturing aspect, the fastening means according to the invention have the advantage that they are particularly simple and devoid of mobile parts (articulations, tongues, lugs, pins, ratchets or hinges, for example).

Such fastening means may further be produced with a minimum of machining operations and steps, hence rapidly and for a reduced cost price.

On the other hand, thanks to the fastening means according to the invention, the making of perforations in the flexible band 15 can be avoided; this flexible band 15 is further fully reversible and the two longitudinal sides thereof can thus be used as a façade.

The fastening means offer the designer/creator several possibilities of metallic ornaments.

Finally, the movement of the band, preferably a band of leather, at the level of the fastening means 1 provides an original and attractive aesthetic aspect, allowing the accessory designer to express himself or herself through stamping, tinting or any other marking means at the central front portion, which is difficult to envisage with the closing means known up to now.

As described hereinabove, such fastening means are particularly adapted for making a belt, in such a manner to close and tighten the two end sections of a same flexible band. But other applications can of course be envisaged, as for example closures of handbags or shoes, in association with two end sections of two separate flexible bands to be assembled.

The invention claimed is:

1. A fastening means including a flexible band for closing and tightening first and second band sections (15*a*, 15*b*) of the flexible band, each of said first and second band sections (15*a*, 15*b*) having a free end (15*a*', 15*b*') and, said first and second band sections being equipped with the fastening means (1) for fastening the first and second band sections to each other, said fastening means (1) comprising:

an end keeper (2) arranged at the free end (15*a*') of the first band section (15*a*) and comprising an opening (5) provided for a crossing of the second band section (15*b*), the first band section (15*a*) being folded over itself and through the opening (5) of the end keeper (2) to form an assembling hem closed by a seam or rivets (15*c*) so as to ensure a fixation of said end keeper (2), the end keeper (2) comprising a ring shaped part which is generally circular in shape, the opening (5) also being generally circular in shape;

a lateral keeper (3) that is located at said second band section (15*b*), remote from the free end (15*b*') of said second band section (15*b*), said lateral keeper (3) comprises two openings, a rear one (9) and a front one (8), separated by a transverse structural element (10), for the crossing of said second band section (15*b*) during closing and tightening operations, said second band section (15*b*) cooperating with said end and lateral keepers (2, 3) during said closing and tightening operations, by being successively introduced, starting from said lateral keeper (3), through the opening (5) of the end keeper (2), the rear opening (9) of said lateral keeper (3) and the front opening (8) of this same lateral keeper (3), so as to be folded into a generally S-shape, with three superimposed portions, namely, successively, (i) a rear portion (15*b*1) extending from said lateral keeper (3) to the opening (5) of said end keeper (2), (ii) an intermediate portion (15*b*2) extending from said opening (5) of the end keeper (2) to the rear opening (9) of said lateral keeper (3), and (iii) a front portion (15*b*3) comprising the free end (15*b*') of said second band section (15*b*), extending through the front opening (8) of said lateral keeper (3) toward said end keeper (2); and a holding keeper (4) that is located at the first band section (15*a*), remote from the free end (15*a*') thereof, said holding keeper (4) comprises two openings (11, 12) separated by a transverse element (13), namely, a rear opening (12) and a front opening (11), passed through by the first band section (15*a*) and by the front portion (15*b*3) of the second band section (15*b*), respectively, to hold the second band section.

2. The fastening means including a flexible band according to claim 1, characterized in that the end keeper (2) has a height (H) higher than a height (h) of the rear opening (9) of the lateral keeper (3), to avoid the crossing thereof through said rear opening (9).

3. The fastening means including a flexible band according to claim 1, characterized in that the transverse structural element (10) of the lateral keeper (3) has a fixed position, and in that the rear opening (9) of said lateral keeper (3) has a width (L) corresponding to twice, or approximately twice, a width (l) of the front opening (8), said rear opening (9) being intended to be passed through by the rear portion (15*b*1) and the intermediate portion (15*b*2) of the second band section (15*b*).

4. The fastening means including a flexible band according to claim 1, characterized in that the lateral keeper (3) has a generally rectangular shape and is consisted of two lateral rods (6*a*) associated with two junction rods (6*b*), and in that the transverse structural element (10) consists of a rod located between said lateral rods (6*a*), parallel to said lateral rods (6*a*) and linking said junction rods (6*b*).

5. The fastening means including a flexible band according to claim 1, characterized in that a structure of the holding keeper (4) is identical to a structure of the lateral keeper (3).

6. The fastening means including a flexible band according to claim 1, characterized in that the lateral keeper (3), and the holding keeper (4), are mounted to slide freely on respective ones of the first and second band sections (15*a*, 15*b*).

7. The fastening means including a flexible band according to claim 1, wherein the flexible band is a clothing belt.

* * * * *